US012414593B2

(12) United States Patent
Yoo

(10) Patent No.: US 12,414,593 B2
(45) Date of Patent: Sep. 16, 2025

(54) PERFORMANCE-BASED ARMWEAR AND HAND COVERAGE FOR AN ACTIVE LIFESTYLE

(71) Applicant: Jacquelyne Yoo, Hightstown, NJ (US)

(72) Inventor: Jacquelyne Yoo, Hightstown, NJ (US)

( * ) Notice: Subject to any disclaimer, the term of this patent is extended or adjusted under 35 U.S.C. 154(b) by 0 days.

(21) Appl. No.: 19/023,329

(22) Filed: Jan. 16, 2025

(65) Prior Publication Data

US 2025/0228314 A1 Jul. 17, 2025

Related U.S. Application Data

(60) Provisional application No. 63/621,794, filed on Jan. 17, 2024.

(51) Int. Cl.
*A41D 27/10* (2006.01)
*A41D 19/00* (2006.01)

(52) U.S. Cl.
CPC ..... *A41D 27/10* (2013.01); *A41D 19/00* (2013.01)

(58) Field of Classification Search
CPC ..... A41D 27/10; A41B 1/10; A41F 19/005
See application file for complete search history.

(56) References Cited

U.S. PATENT DOCUMENTS 731,791 A * 6/1903 Krifka
1,183,792 A * 5/1916 Aron ..... A41D 27/10 2/270
2,274,510 A * 2/1942 Wohl ..... A41D 19/0041 D2/614
2,836,828 A * 6/1958 Henrikson ..... A41D 19/01 2/170
6,430,744 B1 8/2002 Redman et al.
6,839,911 B1 * 1/2005 Mathews ..... A41D 15/00 2/93
6,996,847 B2 * 2/2006 Anderson ..... A41D 19/0013 2/16

(Continued)

FOREIGN PATENT DOCUMENTS

CA 2921376 A1 2/2015
CN 206331799 U 7/2017

(Continued)

OTHER PUBLICATIONS

"Norco Therapeutic Compression Gloves—Full Finger", Allergro Medical, available at "https://www.allegromedical.com/products/norco-therapeutic-compression-gloves-full-finger/", retrieved on June 10, 2025, pp. 5.

(Continued)

*Primary Examiner* — Tajash D Patel
(74) *Attorney, Agent, or Firm* — Gearhart Law LLC

(57) ABSTRACT

A garment is disclosed that comprises a sleeve portion, a hand covering portion, and optionally a thumb covering portion. The garment is ideally suited to changes in weather as the garment can go quickly and facilely from a first position wherein only a sleeve is present to cover an arm to a second position wherein an arm and a hand are both covered. The garment design is highly adaptable in that it can have both mitten like characteristics or glove like characteristics, or a mix of the two. The garment may also be affixed to another garment that covers the upper body of a wearer (e.g., a shirt).

20 Claims, 13 Drawing Sheets

(56) References Cited

U.S. PATENT DOCUMENTS

| | | | | |
|---|---|---|---|---|
| 8,904,564 | B2 * | 12/2014 | Laycock | A41D 19/0041 2/93 |
| 10,194,708 | B2 * | 2/2019 | Rhodes | A41D 27/20 |
| 11,285,032 | B2 | 3/2022 | Eugene et al. | |
| 11,638,453 | B2 * | 5/2023 | Eckensweiler | A41D 15/002 2/125 |
| 12,144,756 | B1 | 11/2024 | Solotoff | |
| 2011/0042425 | A1 | 2/2011 | Norris | |
| 2011/0087145 | A1 | 4/2011 | Farrow et al. | |
| 2013/0184622 | A1 | 7/2013 | Farrow | |
| 2013/0198920 | A1 | 8/2013 | Wittman | |
| 2013/0198922 | A1 | 8/2013 | Wittman | |
| 2013/0227755 | A1 | 9/2013 | Bisaillon | |
| 2015/0000003 | A1 | 1/2015 | Blakely et al. | |
| 2018/0098587 | A1 | 4/2018 | Moore | |

FOREIGN PATENT DOCUMENTS

| | | | | |
|---|---|---|---|---|
| CN | 206978802 | U | 2/2018 | |
| CN | 207100824 | U | 3/2018 | |
| WO | WO-2018132630 | A1 * | 7/2018 | A41D 19/0041 |
| WO | 2024220393 | A2 | 10/2024 | |

OTHER PUBLICATIONS

"Rolyan Forearm Length Right Compression Glove, Full Finger Compression Sleeve to Control Edema and Swelling, Water Retention, and Vericose Veins, Covers Fingers to Forearm on Right Arm, Small", Amazon.com, available at "https://www.amazon.com/Rolyan-Compression-Swelling-RetentionVericose/dp/B06XRGDYX1", retrieved on Jun. 12, 2025, pp. 5.

"L & R ExoSoft Glove 20-30 mmHg", Compression Health, available at "https://compressionhealth.com/l-r-exosoft-glove-20-30mmhg/?sku=104118", retrieved on Jun. 10, 2025, pp. 3.

"Copper Long Arthritis Gloves, Long Wrist Compression Arm Sleeve Carpal Tunnel Gloves, Fingerless Hand Compression Gloves for Men Women Computer Typing, RSI, Support Hands Wrist &Arms—1 Pair (Medium)", Amazon.com, available at "https://www.amazon.com/Arthritis-Compression-Fingerless-Computer-Support/dp/B0C3H4BCH6", retrieved on Jun. 12, 2025, pp. 8.

* cited by examiner

PERFORMANCE-BASED ARMWEAR AND HAND COVERAGE FOR AN ACTIVE LIFESTYLE

CLAIM OF PRIORITY

The present invention claims priority under 35 U.S.C. § 119 (e) to U.S. Provisional Application No. 63/621,794 filed on Jan. 17, 2024, the contents of which are incorporated by reference in its entirety.

FIELD OF THE INVENTION

The present invention relates to a garment that comprises a sleeve portion, a hand covering portion, and optionally a thumb covering portion. The garment is suited to changes in weather as the garment can go quickly and facilely from a first position wherein only a sleeve is present to cover an arm to a second position wherein an arm and a hand are both covered. The garment design is highly adaptable in that it can have both mitten like characteristics or glove like characteristics, or a mix of the two. The garment may also be affixed to another garment that covers the upper body of a wearer (e.g., a shirt). The garment may also be made of high technology fabric that allows it to be worn and used with touch screens.

BACKGROUND OF THE INVENTION

Gloves have been around for millennia, serving both physiological and aesthetic purposes. They have been used for their functional purposes of keeping hands warm and protected. Alternatively, and/or additionally, they have been used as a status symbol, generally showing that the wearer had attained a status of wealth. As examples of the use of gloves and mittens, it was known that during the Ice Age, relatively recently discovered paintings in caves showed drawings of individuals with mittens. More recently, the ancient Egyptians were believed to have worn gloves made out of linen and it is believed that these linen gloves date to a period around the 14th century BC. Moreover, in the tomb of Tutankhamen, gloves were found. In ancient Greece, it was known that gloves were worn from the writings of Homer in The Odyssey. In the middle ages, gloves were made of white silk and pearls and were known to be worn by the various Catholic Popes and other high-ranking clergy members. Later, during the Renaissance period, heavy protective gloves were worn by knights to protect their hands during battle. The knights also wore the gloves as a status symbol. Later, in 18th century England, gentlemen, while attending formal dances, were known to change their gloves after each dance. During the Victorian era, upper-class women wore them as a status symbol. During World War II, bombers wore "gunner's mittens" to protect their hands from the cold.

Compression garments have also been used throughout time with the ancient Greeks and Romans using bandages and other compression garments to treat injuries and promote healing. In the 16th century, silk was used to treat pain from superficial veins. In the 19th century, more elastic materials were introduced into stockings allowing the garments to be used to treat vein issues. Currently, compression clothing is popular with athletes and fitness enthusiasts to increase performance and is used in the medical field to help those with medical issues that can be served by using compression clothing.

However, to date, a garment that comprises a combination of gloves and/or mittens with sleeves, to the inventors' knowledge, is unknown.

BRIEF SUMMARY OF THE INVENTION

In its broadest sense, the present invention relates to an article of clothing that comprises a combination of a sleeve and a glove or mitten that completely covers the fingers. In an embodiment, the article of clothing is directed to a sleeve in combination with a mitten. In a variation, the sleeve and the mitten are joined together by some means such as by sewing, hook and loop, or other means, or alternatively, being one continuous fabric. In an embodiment, the article of clothing can be worn in at least two ways, as a sleeve wherein the mitten is not worn over the hands or as a sleeve wherein the mitten is worn over the hand. In an embodiment, the article of clothing can be made of any material that is suitable for clothes. For example, in an embodiment, the article of clothing may comprise cotton, linen, wool, polyester, Lycra, nylon, silk, denim, leather, spandex, crepe, damask, chiffon, sateen, organza, corduroy, dobby, gabardine, brocade, knit, Hessian fabric, felt, Gore-Tex, Madras, cellulose fiber, bamboo, hemp, velvet, poplin, georgette, broadcloth, jute, flannel, lamé, chintz, Kevlar, lawn cloth, taffeta, gingham, muslin, chenille fabric, twill, tweed, Tartan, suede, polar fleece, coir, velour, percale, voile, or mixtures thereof.

In an embodiment, the covering of the hand is a garment that is similar to a mitten. Mittens are advantageous because they are generally warmer than gloves. Because mittens have less surface area relative to gloves, this smaller surface area exposed to the cold results in hands that tend to lose heat more slowly. Moreover, mittens have shared warmth allowing the fingers in mittens to share their body heat with each other, thereby allowing the hands to stay warmer. Furthermore, mittens tend to have larger internal space, which is better able to accommodate additional insulation.

Mittens do tend to be less dexterous than gloves, which have separate compartments for each finger. This makes gloves better for activities that require precise hand movements, like adjusting ski bindings or using a smartphone. However, in an embodiment, the present invention relates to a garment wherein the fabric is sufficiently thin and pliable so that the garment provides a hand with good dexterity.

In an embodiment, the present invention relates to a sleeve with split-finger mittens, which combine the features of gloves and mittens. For example, the index and middle fingers might be joined together, while the ring and pinky fingers are joined together.

In an embodiment, the mitten portion of the garment comprises 3-in-1 gloves and mittens, which consist of a shell glove or mitten and a removable liner glove or mitten. This allows one to combine the shell and liner for maximum warmth, or wear either one individually in warmer weather.

In an embodiment, the sleeve portion of the garment is a compression sleeve. In an embodiment, the garment comprises a sleeve portion and a mitten portion, wherein the mitten portion can attain at least two conformations, a conformation that has the mitten as part of the sleeve so that it does not cover the hand, and a second conformation as a mitten that covers the hand. In a variation, the mitten portion completely covers the hand so that there is no skin that is exposed to the atmosphere.

In the portion where the fold is sewn together on the sides, there is elastic thread sewn to allow for more ease to stretch over the hand. This is to avoid any tearing.

DETAILED DESCRIPTION OF THE INVENTION

Figure 1:
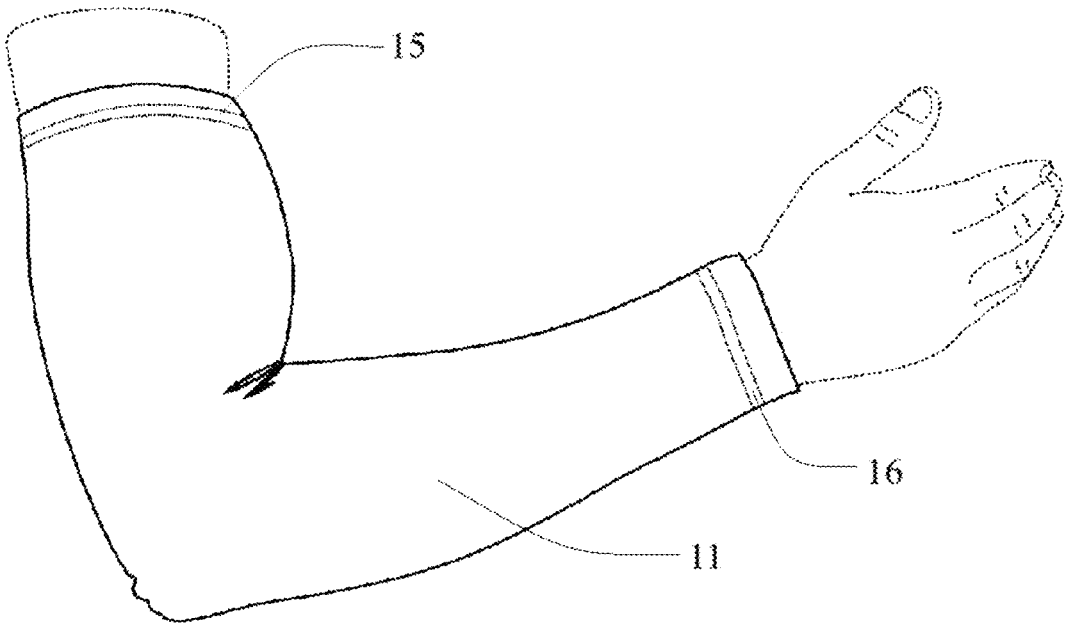
FIG. 1 depicts a front view of an embodiment of the present invention with a sleeve on an arm with a hand exposed.

In an embodiment, the present invention relates to a garment that comprises at least two parts: a sleeve portion that is designed to cover at least a substantial portion of an arm and a hand covering portion that is adapted to fully cover a hand.

In an embodiment, the present invention comprises the following components:

1. Performance Fabric
2. Fabric Thread
3. Elastic
4. A logo that can be heat transferred In an embodiment, the article of clothing can be made of any material that is suitable for clothes. For example, in an embodiment, the article of clothing may comprise cotton, linen, wool, polyester, Lycra, nylon, silk, denim, leather, spandex, crepe, damask, chiffon, sateen, organza, corduroy, dobby, gabardine, brocade, knit, Hessian fabric, felt, Gore-Tex, Madras, cellulose fiber, bamboo, hemp, velvet, poplin, georgette, broadcloth, jute, flannel, lamé, chintz, Kevlar, lawn cloth, taffeta, gingham, muslin, chenille fabric, twill, tweed, Tartan, suede, polar fleece, coir, velour, percale, voile, or mixtures thereof.

In an embodiment, the performance fabric is a fabric that is stretchable and allows the fabric to be used as a compression sleeve. For example, the fabric may be made of elastane (Spandex or Lycra), nylon, polyester, cotton, or combinations thereof. In an embodiment, the sleeve may be made of a combination of nylon and elastane.

In an embodiment, the performance sleeve may also comprise silicone, which provides gripability to the fabric. In a variation, the addition of silicone prevents the sleeve from riding up (or down) the wearer's arm.

In an embodiment, the garment may use more than one type of thread. The garment may comprise both non-elastic and elastic thread. The type of thread that is used may depend upon the location in which it is used. For example, if a stretchy part of the garment requires thread, an elastic thread is preferred. Non stretchy portions use a non-elastic thread.

In an embodiment, the elastic that is used is used for the ends of the garment. Alternatively, the elastic may occur anywhere on the garment as needed. The elastic may be made of a stretchable core and may be a rubber or a synthetic material that is wrapped in a secondary fiber (e.g., exterior threads) such as cotton, nylon, and/or polyester and combinations thereof. The exterior threads and the stretchable core may be woven, braided, or knit together to create the elastic. In an embodiment, the elastic may comprise for example, braided elastic (commonly made from elastane or latex rubber), woven elastic (also commonly made from elastane or latex rubber), knitted flat elastic (made from a latex-free rubber), and/or swim elastic (a type of braided elastic made from the combination of cotton and rubber), and combinations thereof. The rubber may be synthetic or natural. In an embodiment, the elastic may comprise a polyurethane or a silicone.

The elastic may be used to increase the stretch of the garment (e.g., the performance sleeve). The stretch of the garment due to the elastic may be by two times or more its size). The elastic may be stitched directly into the fabric. In an embodiment, the elastic is of a quality that allows it to return to its original shape, thereby providing an ideal fabric for compression.

In an embodiment, the garment may comprise different fabrics appropriately sewn together so that certain portions of the fabric may possess a low Young's modulus and other portions may possess a different Young's modulus (a medium modulus).

In an embodiment, the elastic (e.g., the elastic fabric) may be dyed when it is spun together or after the product (i.e., the garment is made). In an embodiment, the elastic fabric (and/or the garment) has a low modulus (Young's modulus) of about 0.1 to 1 GPa. In an embodiment, the elastic fabric (and/or the garment) may have a medium modulus of about 1 GPa to 5 GPa. In the case where a medium modulus is used, the elastic fabric should be designed so as to more accurately reflect the dimensions of a person's arm. That is the garment (the sleeve) should be close in dimensions to the dimension of the arm of the wearer.

In an embodiment, the logo can be a raised three-dimensional logo. In an embodiment, the logo may be made of silicone, rubber, and/or foam, or combinations thereof. In an embodiment, the raised three-dimensional logo may be made of a rubber silicone mix. In an embodiment, the logo can be transferred onto the garment by a method that includes heat transfer. The heat transfer may occur with pressure applied and at a temperature between 150° C. and 200° C. Alternatively, the heat transfer may occur with pressure applied for between about 15 and 25 seconds at about 160-170° C. with pressure. In an embodiment, heat transfer may occur by printing the logo onto heat transfer paper (e.g., using a color three-dimensional laser printer). In an embodiment, the mirror image of the logo can be printed as when it is applied to the garment (e.g., the performance sleeve), the image will appear in the correct orientation. A heat press machine may be used, which activates the adhesive on the paper, which allows the bonding of the logo to the fabric. After transfer by the heat press machine has been accomplished, the backing paper from the heat transfer paper can be removed.

Alternatively, the logo can be transferred using heat transfer vinyl. The logo image can be designed and then cut using a cutting machine. The excess vinyl can be "weeded"

away from the designed logo. A heat press (or an iron) can be used to apply heat and pressure to the logo so that the logo adheres to the fabric. In a variation, the garment should be placed on a flat surface to ensure good transfer of the logo onto the garment. In an embodiment, the garment should be preheated so that it is at a temperature that allows good transfer of the logo onto the garment. In an embodiment, parchment paper or another heat-resistant sheet (such as Teflon) can be used as a carrier sheet to facilitate the transfer of the logo onto the garment. After transferring the logo to the fabric the carrier sheet can be/should be peeled off.

In an embodiment, the present invention relates to a garment, the methods of making the garment, the functionality of the garment, and how the garment can be worn in at least two different positions. In an embodiment, the garment is a sleeve that comprises at least one portion that comprises a sleeve along with another portion that comprises a part of the garment that covers the hand. In an embodiment, the portion that covers the hand covers the hand completely so that no skin on the wearer is exposed to the elements, including no part of any finger that is exposed to the elements. In an embodiment, the portion that covers the hand is able to go from a position wherein the portion covers the arm (and is part of the arm covering portion) to a position wherein the portion covers the hand completely. Thus, the utility of the hand covering portion is that it has both utility as being able to cover the arm (and optionally also provides some compression capability to the arm) to a position wherein the portion covers the hand. The hand covering portion has functionality in that it is able to provide warmth to the hand but also is able to provide some protection, and optionally and/or additionally is able to provide some compression to the hand.

In an embodiment, the performance fabric as described above is cut according to a pattern with the hand covering. In an embodiment, the pattern comprises four cuts of fabric, two cuts that go from the biceps to the wrist, one cut that covers the hand, and a fourth cut that covers the thumb. The first two cuts are cuts that go from the bicep to the wrist and they comprise one cut that goes from the bicep to the elbow and a second cut that goes from the elbow to the wrist. These two portions can be appropriately sewn together. Alternatively, there may be a hook and loop that occurs at the ends of these two cuts that allow them to be attached to each other by hook and loop attachment.

In an embodiment, if a hook and loop fastener is used, the hook (or alternatively the loop) portion should be appropriately positioned so that the two cuts can be attached together. For example, if the hook portion is on the inside of the first cut, the loop portion should be on the outside of the second cut (thereby allowing the two cuts to be appropriately connected/attached to each other without having to "invert" one side or the other). In an embodiment, the third and fourth cuts comprise the hand and the thumb portion. It should be understood that alternate embodiments are contemplated including an embodiment, wherein there is only one cut of fabric, or alternatively, two cuts of fabric, or alternatively, three cuts of fabric. When four cuts have been used, it has been found that the finished garment fits the arm and hands snuggly so that compression can be appropriately applied and/or the garment provides sufficient warmth to the arm and/or hand.

In an embodiment, if three cuts are used, one cut may cover from the biceps to the wrist and the other two cuts may be a cut for the hand and a last cut for the thumb. Alternatively, the three cuts may comprise one cut for the bicep to elbow, a second cut from the elbow to the wrist, and a third cut that covers both the hand (i.e., the fingers from the hand) and the thumb.

In an embodiment, if two cuts are used, the first cut may cover the arm portion and the second cut may cover the fingers and the thumb. In a variation of this embodiment, the two cuts may be sewn together, or alternatively, they may be attached by hook and loop. The hook and loop should be appropriately positioned so that there is no inversion of either of the cuts (i.e., garment portions).

In an embodiment, fabric thread and elastic are woven together to create a solid piece. The logo can be placed anywhere on the garment. However, in an embodiment, the logo is placed on the upper part of the garment to give the product a more finished and/or aesthetic look.

In an embodiment, the garment can be constructed as described herein. In an embodiment, there may be a top and bottom piece of fabric that when constructed gives coverage from the biceps to the wrist. A third piece of fabric is added which is a hand covering portion, and a fourth piece of fabric may be added which is a thumb covering portion. In an embodiment, elastic may be used that is sewn into the top of the sleeve to prevent it from sliding down the arm.

In an embodiment, the materials are procured, and they can be sewn together with a sewing machine to create a final product. This can be done by someone with all the materials or outsourced to a factory that specializes in developing apparel.

The invention is now described with reference to the figures.

FIG. 1 shows an embodiment of the invention wherein the garment is on a right arm (the back of the hand is being viewed) in a position when the two main portions (i.e., the sleeve and the hand covering portion) of the garment serve as a sleeve. The sleeve can be a regular sleeve without compression or alternatively, it can be a sleeve that serves as a compression garment.

It should be recognized that the garment is shown using the right arm and right hand but it should be understood that the left arm and left hand a merely a mirrored reflection of the garment so that it should be understood that the left arm and hand are also being described herein.

Figure 2:
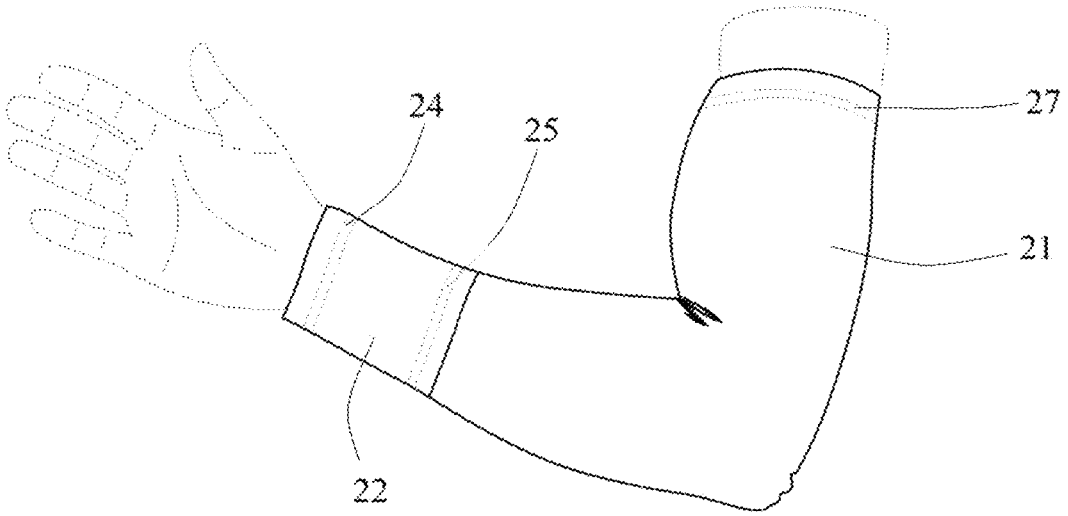
FIG. 2 depicts a back view of an embodiment of the present invention with a sleeve on an arm with a hand exposed.

FIG. 2 shows an embodiment of the invention wherein the garment is on the right arm with the palm of the hand being viewed. It should be noted that there is an arm covering sleeve portion 21 and a hand covering portion 22 shown. The hand covering portion 22 covers a thumb covering portion and this cannot be seen in FIG. 2 (but can be seen in FIG. 5—see 53). At the location of the hand covering portion of the garment, there is excess cloth available (in addition to the hand covering portion) so that the sleeve portion can be extended to a point that is mid-way up the fingers (best seen in FIG. 6*b*). The garment is shown with stitch lines 24, 25, or 27 (ribbing) but it should be understood that the garment may be made in a fashion so that some or all of the stitch lines are not present, including a garment that is devoid of stitch lines (i.e., the garment is all one piece). Thus, FIG. 2 should also be envisioned wherein there are fewer or no stitch lines. The garment may also have appropriately placed bartack stitches (not shown in FIG. 2). "Bartack" stitches are stitches that are used as a reinforcement for parts of or points in garments that are subject to additional stress (e.g., to prevent ripping or tearing of the garment).

Figure 3:
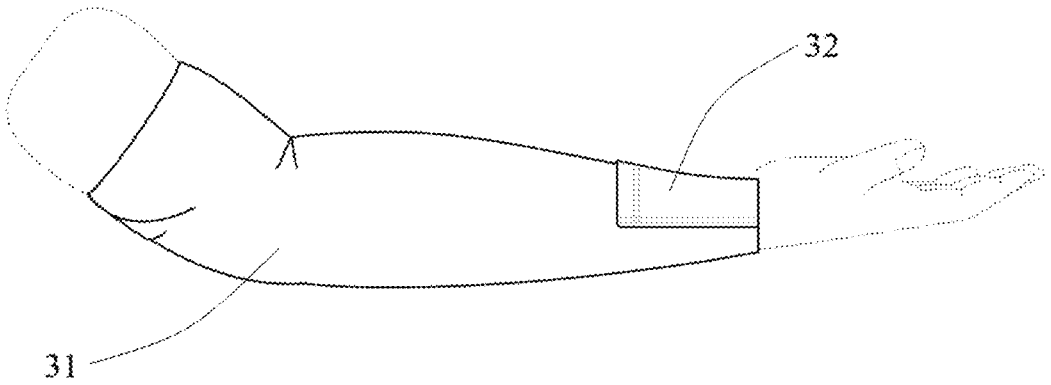
FIG. 3 depicts a side view of an embodiment of the present invention with a sleeve on an arm with a hand exposed.

FIG. 3 shows another view of the invention with the right arm with the palm of the right hand facing up. It should be noted that the hand covering portion 32 is only present on the inside portion of the arm. The arm covering sleeve portion 31 is also visible as a single cut.

Figure 4:
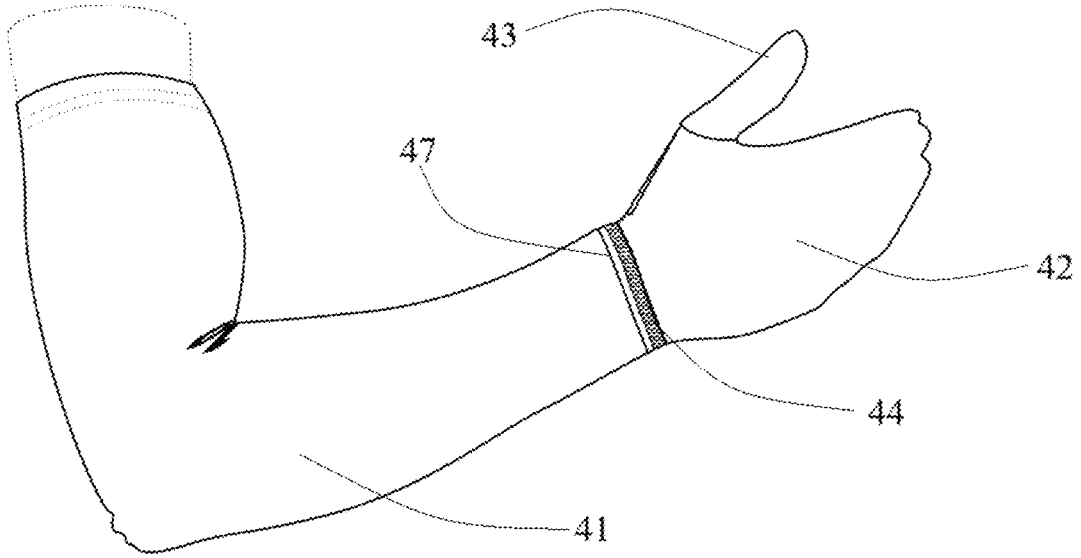
FIG. 4 depicts a view with a sleeve on the arm in the "mitten" configuration showing the garment covering the hand and the thumb exposed in the thumb covering portion.

FIG. 4 shows an embodiment and a view wherein both the arm covering sleeve portion 41 and the hand covering portion 42 are shown. The thumb covering portion 43 is shown in a position wherein it is connected to the hand covering portion 42. Ribbing 44 (e.g., a merrow stitch or a coverstitch) can be seen as well as the end 47 of the hand covering portion after the hand covering portion has been flapped over the fingers. The functionality of how the flap works is better seen in and better understood from FIGS. 6*a-g*.

Figure 5:
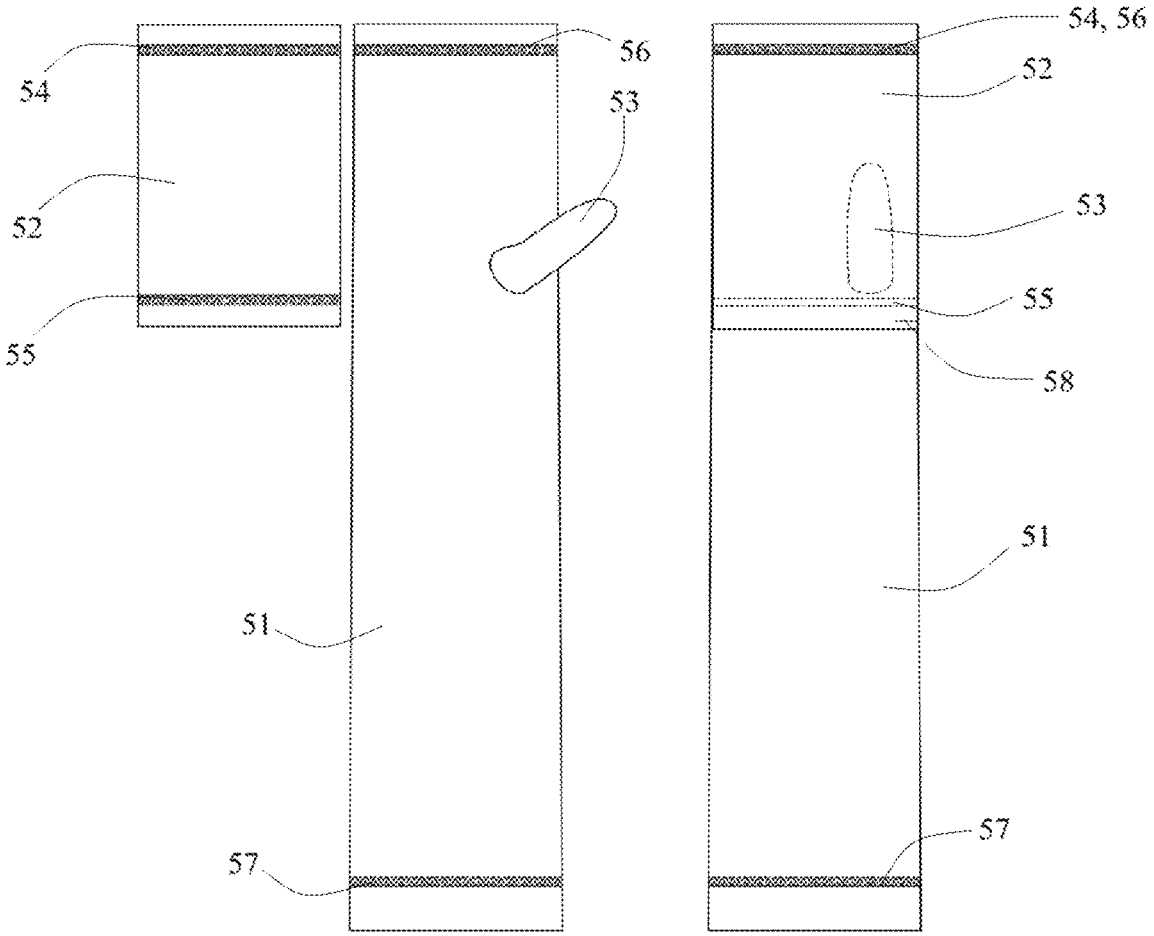
FIG. 5 depicts the materials used to make the garment of the present invention.

FIG. 5 shows the various cuts of cloth that can be seen to make the garment of the present invention. FIG. 5*a* shows a three-cut version of the garment, wherein the hand covering portion 52 is shown, the sleeve portion 51, and the thumb covering portion 53. In this embodiment, it should be apparent that the thumb covering portion 53 is attached to sleeve portion 51 (either by sewing or by another means such as hook and loop). Ribbing 54, 55, 56, and 57 can be seen that provide elasticity that allows the garment to either serve as a compression garment or allows the garment to be relatively tight at certain positions in the garment (e.g., at the wrist). The ribbing in an embodiment, prevents the sleeves from being able to easily move on the arm so that the garment remains relatively fixed in position. FIG. 5*b* shows the hand covering portion 52 which has been affixed to the sleeve portion 51. The hand covering portion 52 obscures the thumb covering portion 53 (note dashed line for the thumb covering portion) when the hand covering portion 52 serves as a part of the arm covering. FIG. 5 also shows an exemplary Bartack stitch 58, that is appropriately placed so as to provide reinforcement for a part of the garment that is subject to additional stress (relative to other parts of the garment). This Bartack stitch prevents ripping or tearing of the garment or ameliorates the strength/fortitude/durability of the garment. FIG. 5 is shown with ribbing but it should be understood that some or all of the ribbing may not be present (e.g., the garment may be made as single piece).

Figure 6A:
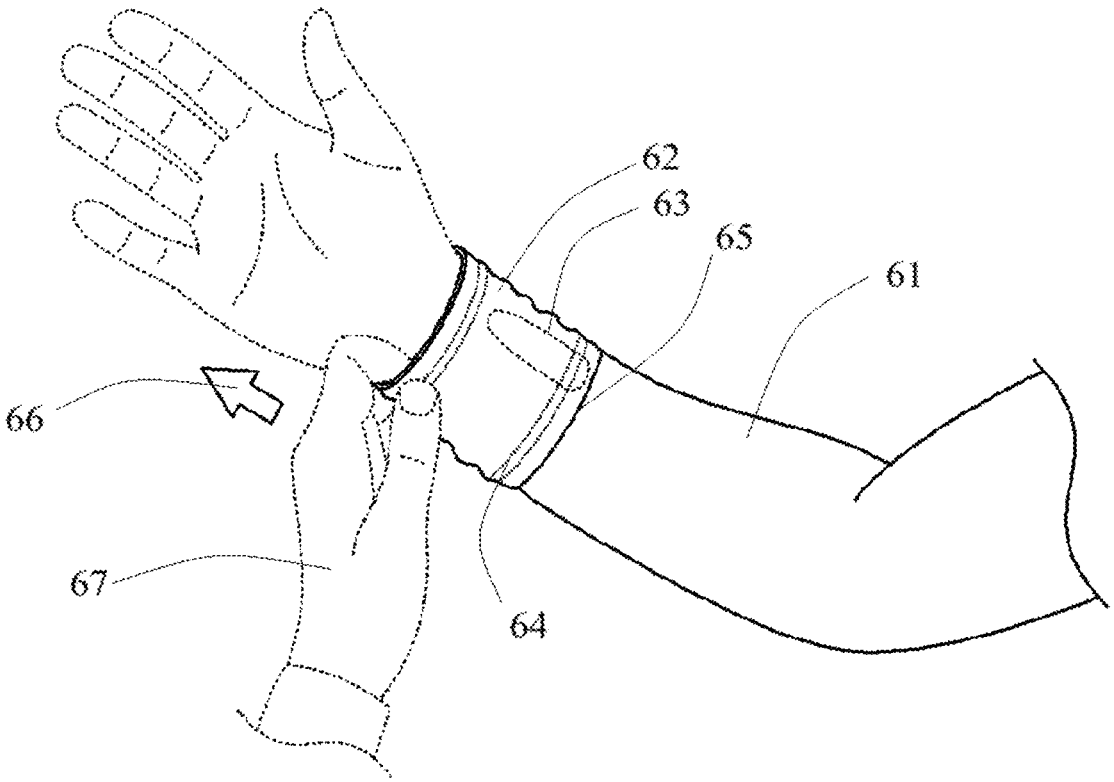
FIGS. 6*a-g* depicts views showing the transition from the hand protruding from the garment to being completely covered to create the "mitten" configuration to the flap flipping back over to generate the sleeve configuration.
Figure 6B:
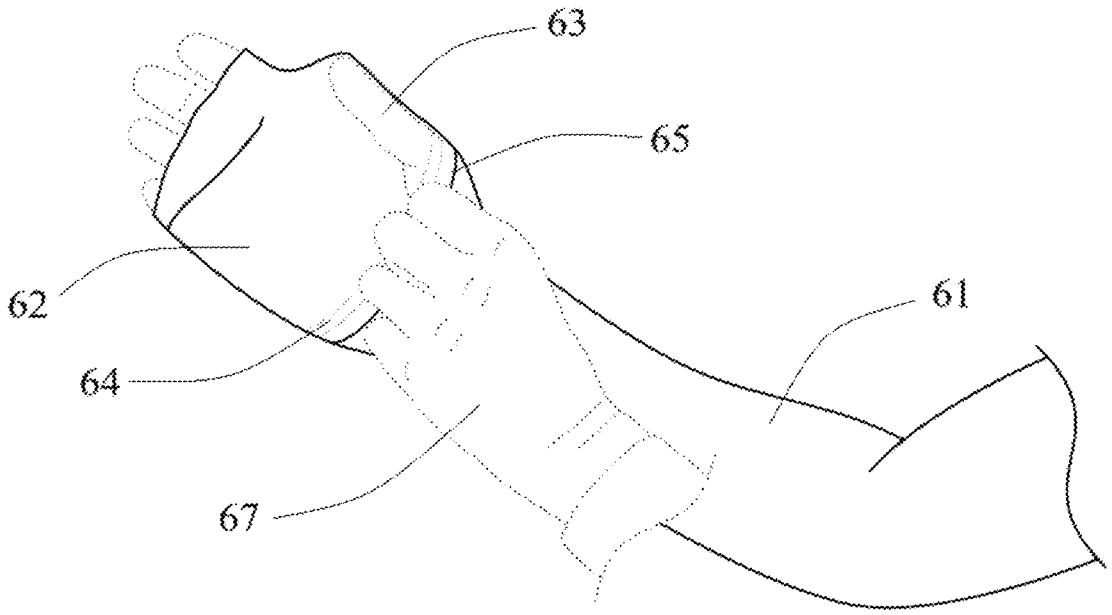
Figure 6C:
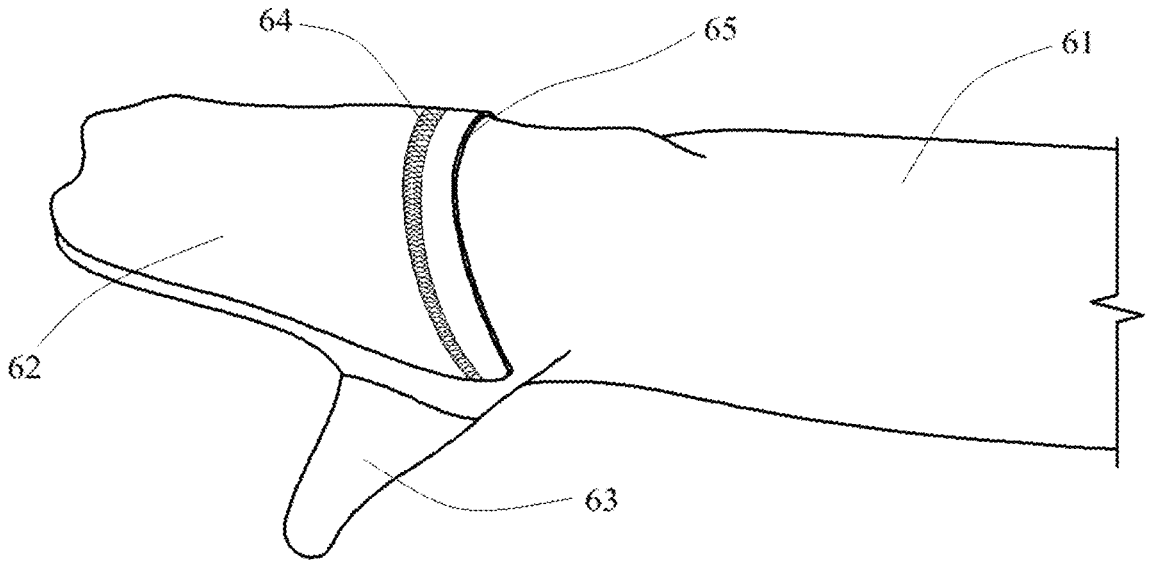

FIGS. 6*a-g* shows the operation of the garment and how the garment can go from a position wherein the garment is merely a sleeve to a position wherein it is a sleeve and hand covering garment and back to a sleeve. In this regard, FIGS. 6*a-c* represent different snapshots in time in the transition from the hand covering portion being a part of the sleeve to the hand covering portion 62 covering the fingers on a hand. FIGS. 6*d-g* show different snap shots in time going from the hand covering portion 62 covering the fingers to the hand covering portion 62 and the thumb covering portion 63 being a part of the sleeve. Stated differently, FIGS. 6*a-c* represent the garment going from a position where the hand is uncovered to covered while FIGS. 6*d-g* show the transition from the hand being covered to being uncovered.

FIG. 6*a* shows the first step of the process of changing the garment from a sleeve position to a sleeve and hand covering position. The hand covering portion 62 obscures the thumb covering portion 63 (not seen in FIG. 6*a* but seen as below the hand covering portion in dotted lines in FIG. 6*b*). There is excess cloth available under the hand covering portion 62 so that when the sleeve is extended (by the left hand 67) in a direction shown by arrow 66 it is able to attain a position that is partially up the fingers 68 (see FIG. 6*b*). At this point (see FIG. 6*b*), the left hand 67 takes the hand covering portion 62 at the position shown by the left hand 67 and inverts the hand covering portion over the fingers thereby inverting the hand covering portion 62 (i.e., the outside side of the hand covering portion becomes the inside side of the hand covering portion when the hand covering portion completely covers the hand). Also, the thumb covering portion is also revealed at this point with the thumb securely positioned in the thumb covering portion. See FIG. 6*c*. FIG. 6*b* shows the palm side of the right hand and FIG. 6*c* shows the back side of the right hand.

Although the hand covering portion (which covers the fingers) is shown as a mitten-like accessory, it should be understood that the hand covering portion may be designed to be a glove-like accessory, wherein the individual fingers can each have their own covering. The mitten-like accessory as shown here provides the fingers with greater warming as described herein. In an embodiment, a mix of a mitten and a glove is contemplated. For example, there may be a hand covering portion that comprises two distinct hand covering accessories (in addition to the separate and distinct thumb covering portion). As an example, there may be one distinct hand covering accessory that covers the index finger and middle finger together and a second distinct hand covering accessory that covers the ring finger and pinkie together. Accordingly, in such an embodiment, a mix between a mitten and a glove has been attained. Although this embodiment describes a mix that comprises three appendages (i.e., one appendage for the thumb, one for the index and middle finger, and one for the ring finger and pinkie), the present invention also contemplates that a four appendage mix may be attained wherein any two adjacent fingers may be placed together in an appendage and all of the other fingers in their separate and distinct covering. Thus, any number of appendages of the garment from 2 (i.e., a mitten) to 5 (i.e., a glove) may be attained (i.e., 2, 3, 4, or 5).

In FIG. 6*c*, it should be noted that this shows the garment wherein the sleeve portion 61, the hand covering portion 62, and the thumb covering portion 63 are all covering the arm, the fingers, and the thumb, respectively. It should be noted that in an embodiment, there exists ribbing 64 which allows the hand covering portion 62 to remain in place. The end 65 of the hand covering portion 62 is also shown.

Figure 6D:
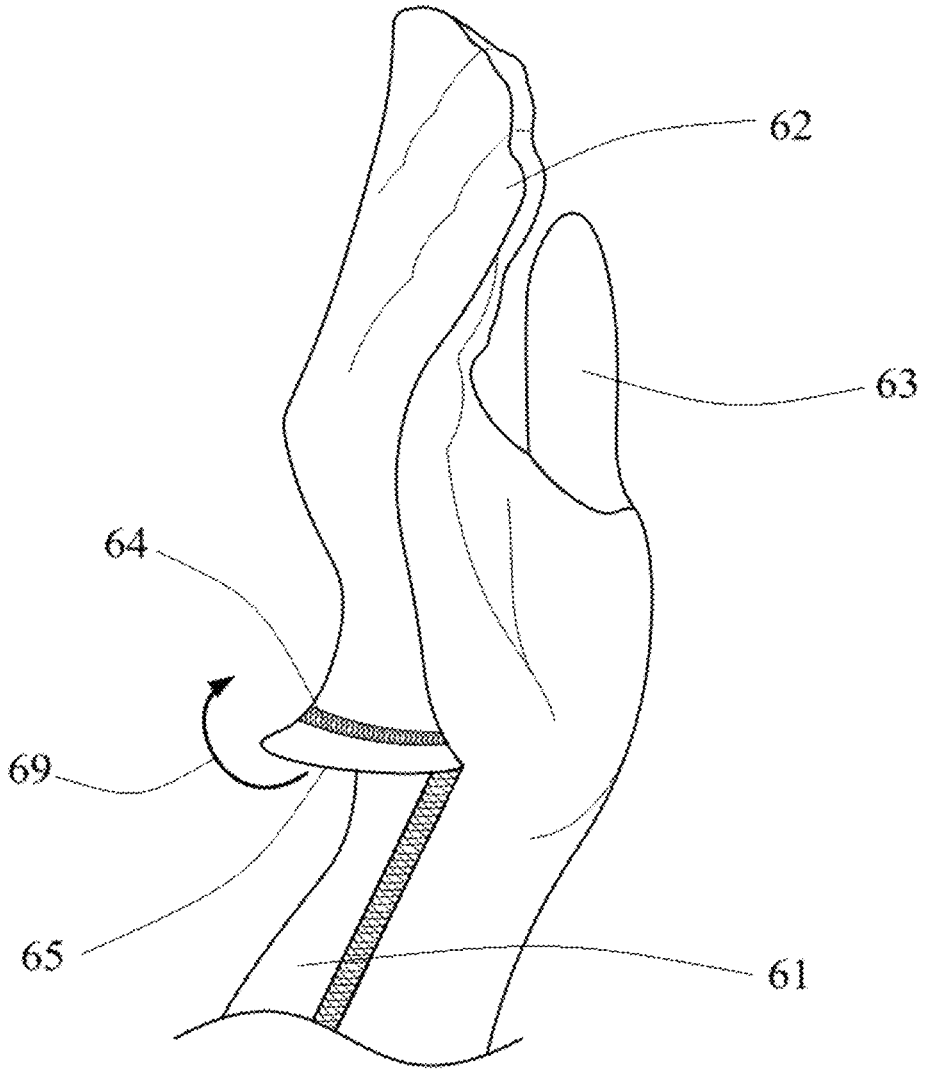

As shown in FIG. 6*d*, when the hand covering portion 62 is being removed, the end 65 of the hand covering portion is grabbed by the left hand and flipped over the fingers in the opposite direction as shown by arrow 69 taking the garment from a position wherein the hand covering portion is covering the fingers to a position wherein the hand covering portion is not covering the fingers.

Figure 6E:
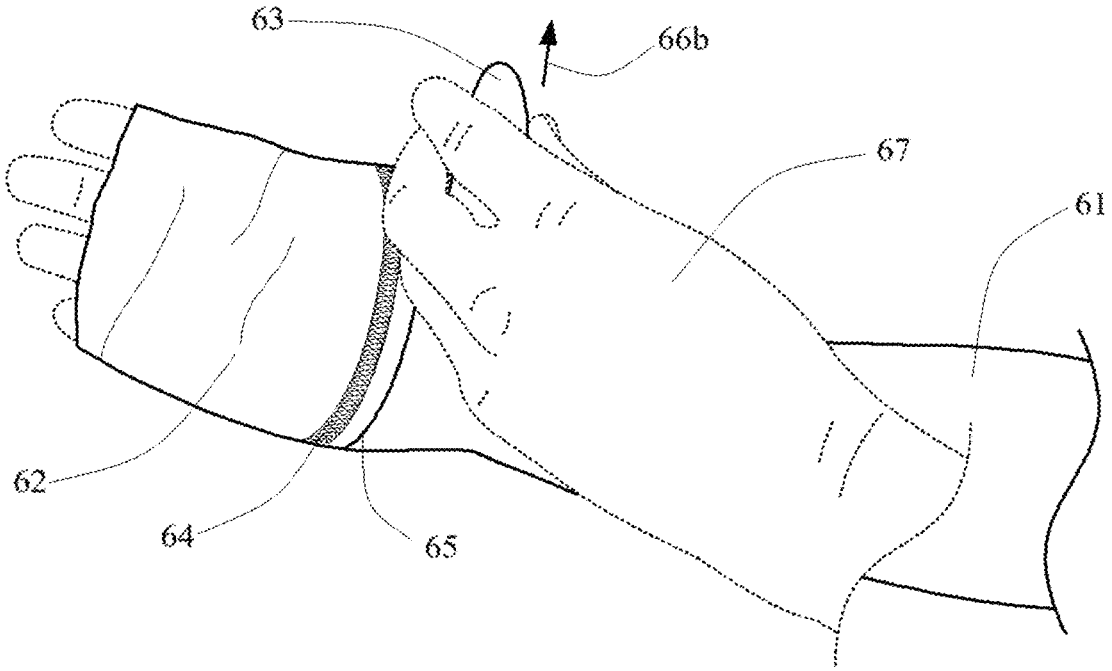
Figure 6F:
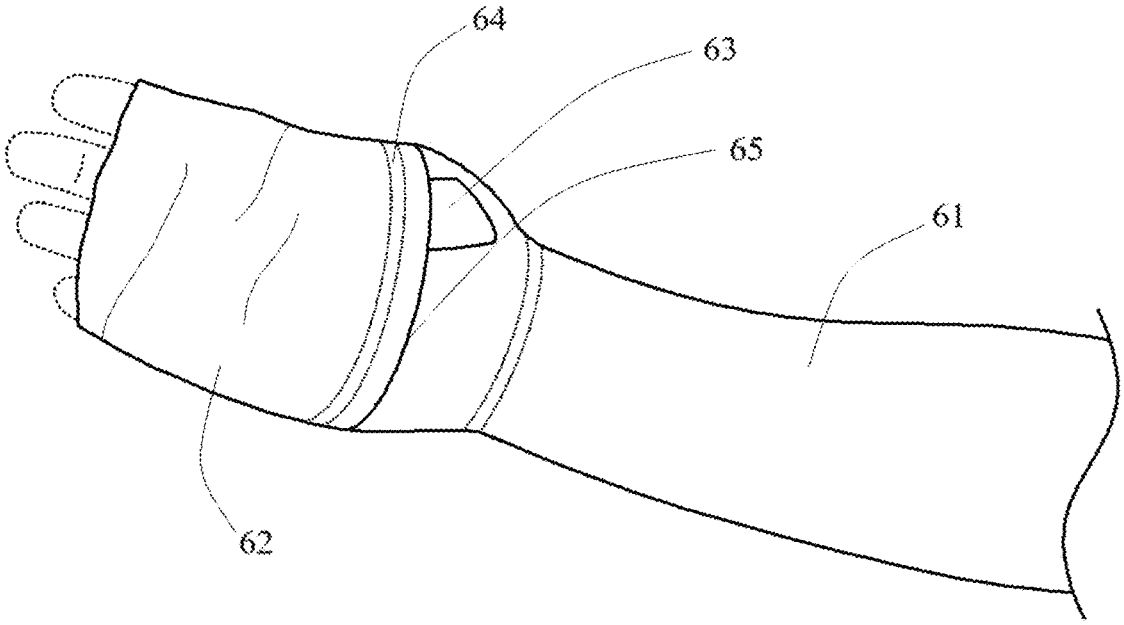
Figure 6G:
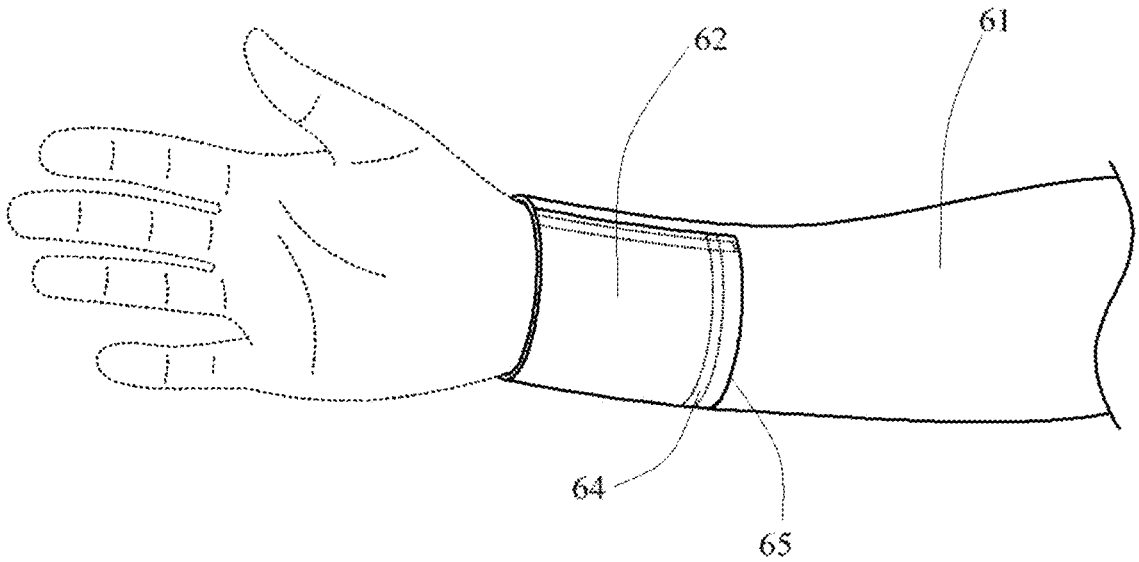

FIG. 6*e* shows the left hand 67 helping to remove the thumb covering portion 63 from the thumb in the direction of arrow 66*b*. As shown in FIG. 6*f*, the thumb covering portion 63 is slipped under the hand covering portion 62. Finally, the sleeve portion 61 and the hand covering portion 62 are moved away from the hand towards sleeve portion 61 to achieve the configuration of the garment shown in FIG. 6*g*. FIG. 6*g* shows the garment with the hand covering portion 62 completely obscuring the thumb covering portion (not seen in FIG. 6*g*).

Figure 7:
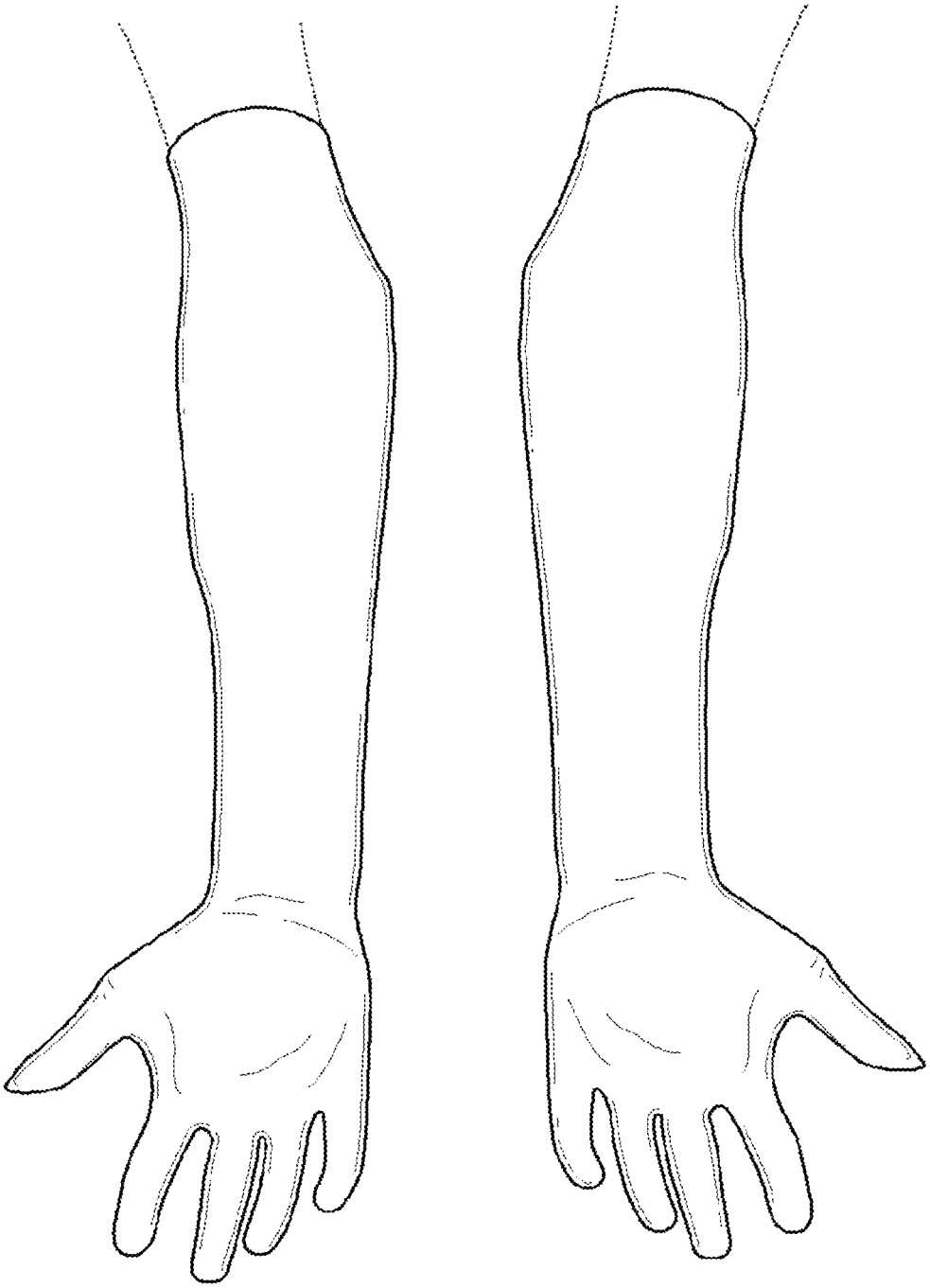
FIG. 7 shows a view of a seamless embodiment of the present invention.

FIG. 7 shows another embodiment of the invention wherein there are no seams. As shown in this embodiment, the hand covering portion are gloves rather than mittens as disclosed in other embodiments. However, it should be understood that seamless mittens are also contemplated.

Although all of the figures show embodiments with sleeves and hand covering portions, it should be understood that the garments disclosed herein can be expanded into a full top in addition to the sleeve portion/hand garment. The garment will have a similar function to the garments that have been illustrated in the figures, but the garment will have more coverage.

The invention is ideally suited to be worn during seasonal changes such as winter to spring or summer to fall. The garment is also ideally suited to be used at different times during the day due to the adaptability of the garment allowing the full garment with the hand covering portion and thumb covering portion covering the fingers and thumb respectively to be worn during cooler temperatures that occur in the early mornings or late at night and the sleeve without the hand covering portion and thumb covering portion covering the fingers and thumb during warmer times. Alternatively, the garment can also be worn as a normal compression sleeve without the hand covering portion.

In an embodiment, the garment can be made out of different fabrics that are typically used outside of performance wear, with such materials comprising but not limited to knit and/or yarn, or a combination of the two. In an embodiment, the present invention is directed to all yarn, knit, and woven fabrics.

In a further embodiment, the fabric that may be used in the garment includes "tech touch" fabrics that allow for capacitive sensing applications. Thus, the fabric that may be used includes the ability to easily access any smart device or other touch screen that would require fingers.

In an embodiment, the thumb portion can also be seamless meaning that the garment can also be made as an all-in-one construction (see FIG. 7 for example). For example, the present invention contemplates a sweater knit glove wherein the thumb covering portion is a continuation of the same knitting from the wrist and not a completely separate piece of fabric (as shown in FIG. 5).

In an embodiment, the compression sleeve applies between about 20-40 mm Hg, with a mild compression sleeve applying about 20 mm Hg, a moderate about 30 mm Hg, and a firm applying about 40 mm Hg. In an embodiment, the sleeves of the present invention can be used for medical purposes. For example, the compression sleeve of the present invention can be used for patients who suffer from lymphedema (a buildup of lymph fluid that causes swelling in the body's tissue(s)). Other conditions that may be treated by the compression sleeve portion of the garment by the present invention include orthostatic intolerance, general swelling, poor circulation, or post-surgery healing. The compression garment of the present invention may also be used to increase blood flow, the reduce muscle pain and/or fatigue after exertion, and to prevent chafing, and/or for warmth.

In an embodiment, the present invention relates to a garment that comprises two portions, a first portion that comprises a sleeve portion, and a second portion that comprises a hand covering portion, the garment is designed and configured to have the second portion undergo a transition from a first position to a second position or from the second position to the first position, the first position comprising a first mode wherein the second portion does not cover a hand of a wearer and the second position comprising a second mode wherein the second portion does cover the hand of the wearer.

In a variation, when the garment is in the first position, at least a part of the second portion is a part of the sleeve portion. In a variation, the garment further comprises a thumb covering portion. In a variation, the thumb covering portion is affixed to the sleeve portion. In a variation, the thumb covering portion is obscured by the second portion when the garment is in the first position. In a variation, the first portion is affixed to the second portion by sewing or by hook and loop. In a variation, the first portion and the second portion are seamlessly joined together.

In an embodiment, the second portion, or the hand covering portion is a mitten. In a variation, the second portion is a glove. In a variation, the second portion comprises a mix of a mitten and a glove. In a variation, at least one of the first portion and the second portion comprises compression ability. In a variation, both the first and second portions comprise compression ability. In a variation, the compression ability is between 20-40 mm Hg.

In an embodiment, the garment as disclosed has a second portion that comprises two sides, a first side, and a second side so that when the garment is in the first position, the first side faces outward away from the arm and the second side faces inward towards the arm and when the garment is in the second position, the first side faces inwards towards the hand and the second side face outwards away from the hand. That is, the hand covering portion becomes inverted. In a variation, the first portion is affixed to the second portion by fabric thread.

In a variation, the garment comprises a fabric that is capable of stretching 150%, or 200%, or 300%, or 400% or 500% or more. In a variation, the garment comprises elastane and polyester. In a variation, the garment is further attached to another garment that comprises an upper arm covering and torso covering accessory. In a variation, the garment is seamless.

In a variation, the garment is further affixed to another garment that covers the upper arms and torso of a wearer.

In an embodiment, the present invention relates to methods, such as methods of covering an arm and a hand, methods of providing compression to an arm and/or a hand, and/or a method of warming an arm and/or a hand comprising using the garment as described herein.

It should be understood and contemplated and within the scope of the present invention that any feature that is enumerated above can be combined with any other feature that is enumerated above as long as those features are not incompatible. Whenever ranges are mentioned, any real number that fits within the range of that range is contemplated as an endpoint to generate subranges. In any event, the invention is defined by the below claims.

I claim:

1. A garment comprising:

a first portion that comprises a sleeve portion, a thumb covering portion, wherein the thumb covering portion is attached to the sleeve portion; and a second portion that comprises a hand covering portion, wherein the hand covering portion comprises a material having four edges directly affixed to the sleeve portion, and wherein the garment is designed and configured to have the second portion undergo a transition from a first position to a second position or from the second position to the first position, wherein the first position comprises a first mode wherein the second portion does not cover a hand of a wearer, wherein the second position comprises a second mode wherein the second portion does cover the hand of the wearer, and wherein the thumb covering portion is completely covered by the hand covering portion when the garment is in the first position.

2. The garment of claim 1, wherein when the garment is in the first position, at least a part of the second portion is a part of the sleeve portion.

3. The garment of claim 1, wherein the first portion is affixed to the second portion by sewing or by hook and loop.

4. The garment of claim 1, wherein the first portion and the second portion are seamlessly joined together.

5. The garment of claim 1, wherein the second portion is a mitten.

6. The garment of claim 1, wherein the second portion is a glove.

7. The garment of claim 1, wherein the second portion comprises a mix of a mitten and a glove.

8. The garment of claim 1, wherein at least one of the first portion and the second portion comprises compression ability.

9. The garment of claim 7, wherein the compression ability is between 20-40 mm Hg.

10. The garment of claim 1, wherein the second portion comprises two sides, a first side and a second side so that when the garment is in the first position, the first side faces outward away from the arm and the second side faces inward towards the arm and when the garment is in the second position, the first side faces inwards towards the hand and the second side face outwards away from the hand.

11. The garment of claim 1, wherein the first portion is affixed to the second portion by fabric thread.

12. The garment of claim 1, wherein the garment comprises a fabric that is capable of stretching 200% or more.

13. The garment of claim 9, wherein the garment comprises elastane and polyester.

14. The garment of claim 1, wherein the garment is further attached to another garment that comprises an upper arm covering and torso covering accessory.

15. The garment of claim 1, wherein the garment is seamless.

16. The garment of claim 1, which is further affixed to another garment that covers the upper arms and torso of a wearer.

17. A method of covering an arm and a hand, comprising using the garment of claim 1.

18. A garment consisting of:

a first portion that comprises a sleeve portion, a thumb covering portion, wherein the thumb covering portion is attached to the sleeve portion; and a second portion that comprises a hand covering portion, wherein the hand covering portion comprises a material having four edges directly affixed to the sleeve portion, wherein the hand covering portion has ribbing along a first edge and a second edge of the four edges, wherein the first edge is affixed to an edge of an opening of the sleeve portion, and wherein the garment is designed and configured to have the second portion undergo a transition from a first position to a second position or from the second position to the first position, wherein the first position comprises a first mode wherein the second portion does not cover a hand of a wearer, wherein the second position comprises a second mode wherein the second portion covers the hand of the wearer, and wherein the thumb covering portion is covered by the second portion when the garment is in the first position.

19. The garment of claim 1, further comprising a Bartack stitch positioned between the thumb covering portion and a terminal edge of the sleeve portion.

20. The garment of claim 1, wherein an edge of the material comprising the thumb covering portion is affixed to an edge of an opening of the sleeve portion.

* * * * *